US006776470B2

(12) United States Patent
Steinmetz et al.

(10) Patent No.: US 6,776,470 B2
(45) Date of Patent: Aug. 17, 2004

(54) MEMORY DEVICE ON A PRINTER CONSUMABLE PROGRAMMED WITH TARGET INTERVENTION RATE DATA AND METHODS

(75) Inventors: Charles R. Steinmetz, Corvallis, OR (US); Lee S Mason, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/210,389

(22) Filed: Jul. 31, 2002

(65) Prior Publication Data

US 2004/0021722 A1 Feb. 5, 2004

(51) Int. Cl.[7] ..... B41J 29/393; B41J 29/38; B41J 2/195

(52) U.S. Cl. ..... 347/19; 347/14; 347/7

(58) Field of Search ..... 347/19, 14, 12, 347/7

(56) References Cited

U.S. PATENT DOCUMENTS 5,610,635 A * 3/1997 Murray et al. ..... 347/7
6,494,559 B1 * 12/2002 Tsuji ..... 347/19

* cited by examiner

*Primary Examiner*—Stephen D. Meier
*Assistant Examiner*—Alfred Dudding
(74) *Attorney, Agent, or Firm*—Larry Baker

(57) ABSTRACT

The present invention contemplates providing apparatus and methods for recommending to a consumer an optimal replacement consumable size, based on a record of the consumer's past utilization rate and on recommended intervention rate information stored in a memory device on the consumable.

14 Claims, 5 Drawing Sheets

MEMORY DEVICE ON A PRINTER CONSUMABLE PROGRAMMED WITH TARGET INTERVENTION RATE DATA AND METHODS

FIELD OF THE INVENTION

This invention relates to printer consumables and, more particularly, to an information storage device on a printer consumable, and to methods of utilizing the stored information in the device.

BACKGROUND OF THE INVENTION

Inkjet printing systems are well known in the art. One type of inkjet printing system uses a printhead mounted to a carriage that is moved back and forth over print media, such as paper. As the printhead passes over appropriate locations on the print media, a control system activates the printhead to eject ink drops onto the print media and form desired images and characters. To work properly, such printing systems must have a reliable supply of ink for the printhead.

This ink may be supplied from an ink container that is mounted to and moves with the printer carriage. In some inkjet printers, the ink supply is replaceable separately from the printhead. In others, the printhead and ink supply together form an integral unit that is replaced as a unit once the ink is depleted.

In another type of inkjet printing system, referred to as "off-axis", the ink supply is not carried on the print carriage with the printhead, but is stationary and remotely located from the printhead. Typically the printhead is fluidically coupled to a replaceable ink supply or container via a conduit such as a flexible tube, allowing the printhead to be continuously replenished during a printing operation. Alternatively, the printhead may be provided with ink intermittently, traveling to a stationary reservoir for periodic replenishment.

Regardless of the type of inkjet printing system, periodic replacement of the ink supply is required. When the supply is replaced, it is useful to supply the printer software driver with information about the new ink supply. To that end, the supply may have an integral information storage device, such as described in U.S. Pat. No. 5,699,091, "Replaceable part with integral memory for usage, calibration and other data." When installed into the printing system, electrical communication between the printing system and the memory device is established. This electrical connection allows for the exchange of information between the printing system electronics and the memory device.

The memory device typically stores information that is utilized by the printing system electronics to ensure compatibility and print quality. The memory device may include "read only" portions that are programmed at the time of manufacture; "right once" portions that are permanently altered when written to by the printing system, and non-volatile alterable portions that may be repeatedly modified by the printing system.

Typically, inkjet printing systems have used ink supplies having a fixed, standardized volume of ink. Printing system users, however, have widely-varying patterns of ink usage. Depending on a user's printing behavior, some users deplete a supply quickly and therefore need to replace supplies often; other users deplete a supply slowly, such that the ink in a supply "expires" before it can be fully utilized.

To accommodate the various patterns of ink usage, a printing system may be configured to accept multiple sizes of ink supplies. Replacement ink supplies may then be made available to users in a variety of sizes, such that a user may tailor the supply size to their printing needs. Providing a variety of replacement ink supply sizes, however, can confuse the printing system user, since it may not be apparent to the user which of the available replacement sizes is optimal for their needs.

Thus there is a need for apparatus and methods which assist a printer user in selecting an appropriate replacement ink supply.

SUMMARY OF THE INVENTION

Embodiments of the present invention provide apparatus and methods for recommending to a consumer an optimal replacement consumable size, based on a record of the consumer's past utilization rate and on recommended intervention rate information stored in a memory device on the consumable.

Other aspects and advantages of the present invention will become apparent from the following detailed description, taken in conjunction with the accompanying drawings, illustrating by way of example the principles of the invention.

BRIEF DESCRIPTION OF THE DRAWINGS

FIG. 3, FIGS. 3A, 3B, 3C illustrate exemplary embodiments of replacement ink containers having different internal volumes but a common printer interface; each of the embodiments is shown in both front view and side view.

DETAILED DESCRIPTION OF THE INVENTION

Figures 1A, 1B:
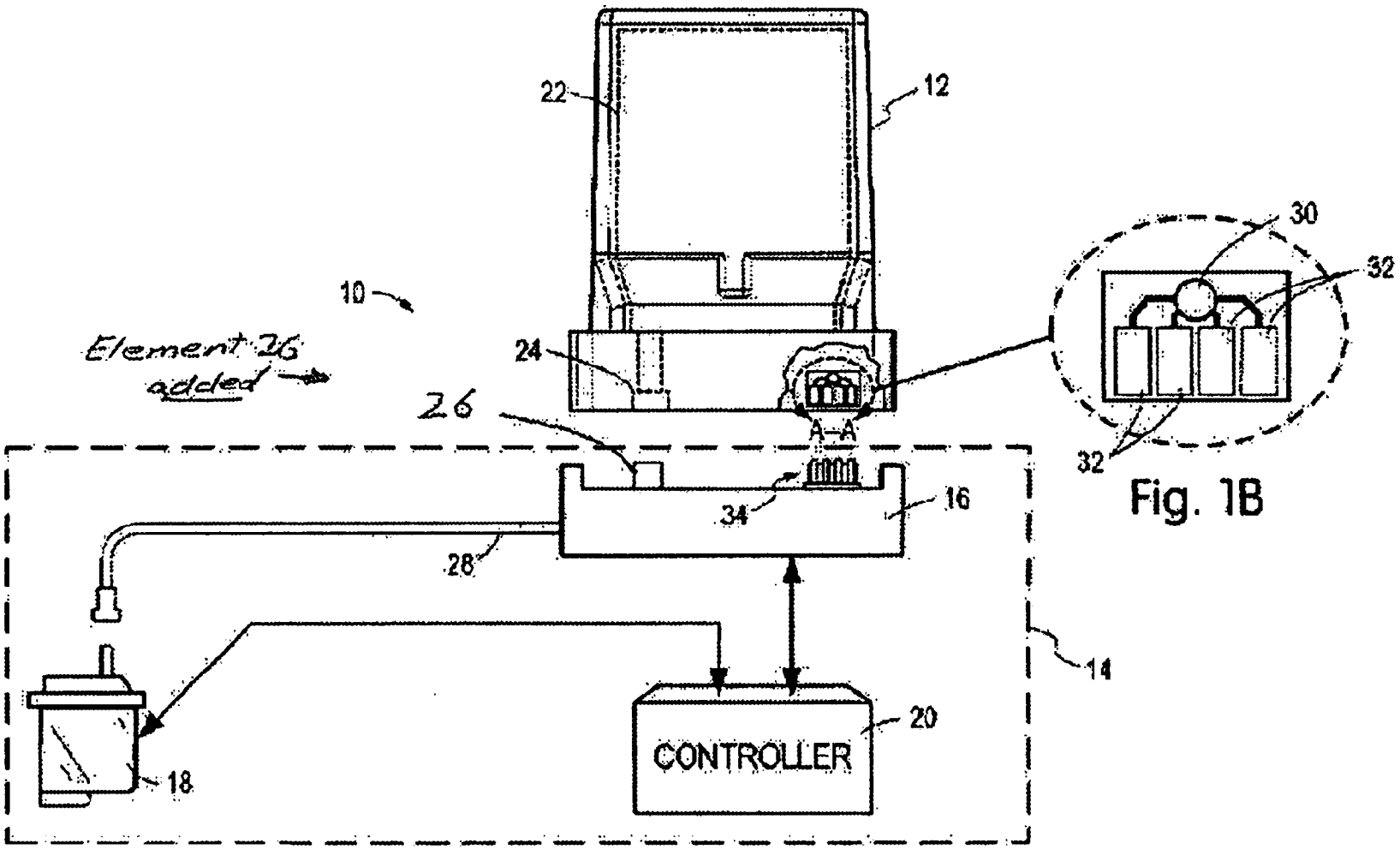
FIGS. 1A and 1B depict in schematic form an exemplary inkjet printing system that includes replaceable ink container having a memory thereon for transferring information from the ink container to a printer controller.

FIGS. 1A and 1B illustrate an exemplary inkjet printing system 10 which may incorporate the present invention. The inkjet printing system 10 includes an ink container or cartridge 12 and a printer portion 14. The ink container has a connection portion 13 for mating with the printer. The printer portion 14 includes an ink container receiving station or a receptacle 16, a printhead 18 and a controller 20. With the ink container 12 properly inserted into the ink container receiving station 16, an electrical and a fluidic coupling is established between the ink container 12 and the printer portion 14. The fluidic coupling allows ink stored within the ink container 12 to be provided to the printhead 18. The electrical coupling allows information to be passed between the ink container 12 and the printer portion 14 to ensure the operation of printer portion 14 is compatible with the ink contained in the ink cartridge 12 to achieve optimal print quality.

In addition to transferring information between the printer portion 14 and the ink container 12, the controller 20 controls the relative movement of the printhead 18 and the print media (not shown). The controller 20 also selectively activates the printhead 18 to deposit ink on the print media.

By selectively activating the printhead 18, as the printhead 18 and print media are moved relative to each other, images and text are formed on print media.

The ink container 12 includes a reservoir 22 for storing ink. A fluid outlet 24 is provided that is in fluid communication with the fluid reservoir 22. The fluid outlet 24 is configured for connection to a complimentary fluid inlet 26 associated with the ink container receiving station 16. A fluid conduit 28 is connected between the fluid inlet 26 and the printhead 18. This fluid conduit 28 may be a continuous fluid conduit in the case of a flexible conduit or an intermittent fluid conduit in the case where the printhead is positioned at a refilling station for replenishing ink. In either case, with the ink container 12 properly inserted into the ink container receiving station 16, fluid communication is established between the ink container 12 and the printhead 18.

The ink container 12 also includes an information storage device or memory 30 for storing information related to the ink container 12. A plurality of electrical contacts 32 are provided that are each electrically connected to the electrical storage device 30. With the ink container 12 properly inserted into the ink container receiving station 16, each of the plurality of electrical contacts 32 engage each of a plurality of electrical contacts 34 associated with the ink container receiving station 16. Each of the plurality of electrical contacts 34 is electrically connected to the controller 20 by a plurality of electrical conductors. With proper insertion of the ink container 12 into the ink container receiving station 16, the memory 30 associated with the ink container 12 is electrically connected to the controller 20 allowing information to be transferred between the ink container 12 and the printer portion 14.

The memory 30 associated with the ink container 12 is shown having 4 electrical contacts or terminals 34, although the number of terminals can be even fewer than four. It is generally preferred that the number of electrical contacts 32 be kept relatively small in order to increase the reliability of the connection between the ink container 12 and the printer portion 14.

The memory device may alternatively have a wireless communications interface (not shown), as, for example, disclosed in U.S. Pat. No. 6,312,106 "Method And Apparatus For Transferring Information Between A Replaceable Consumable And A Printing Device." The memory device may contain pre-programmed "read only" data, "right once" fields, and alterable non-volatile memory.

Figure 2:
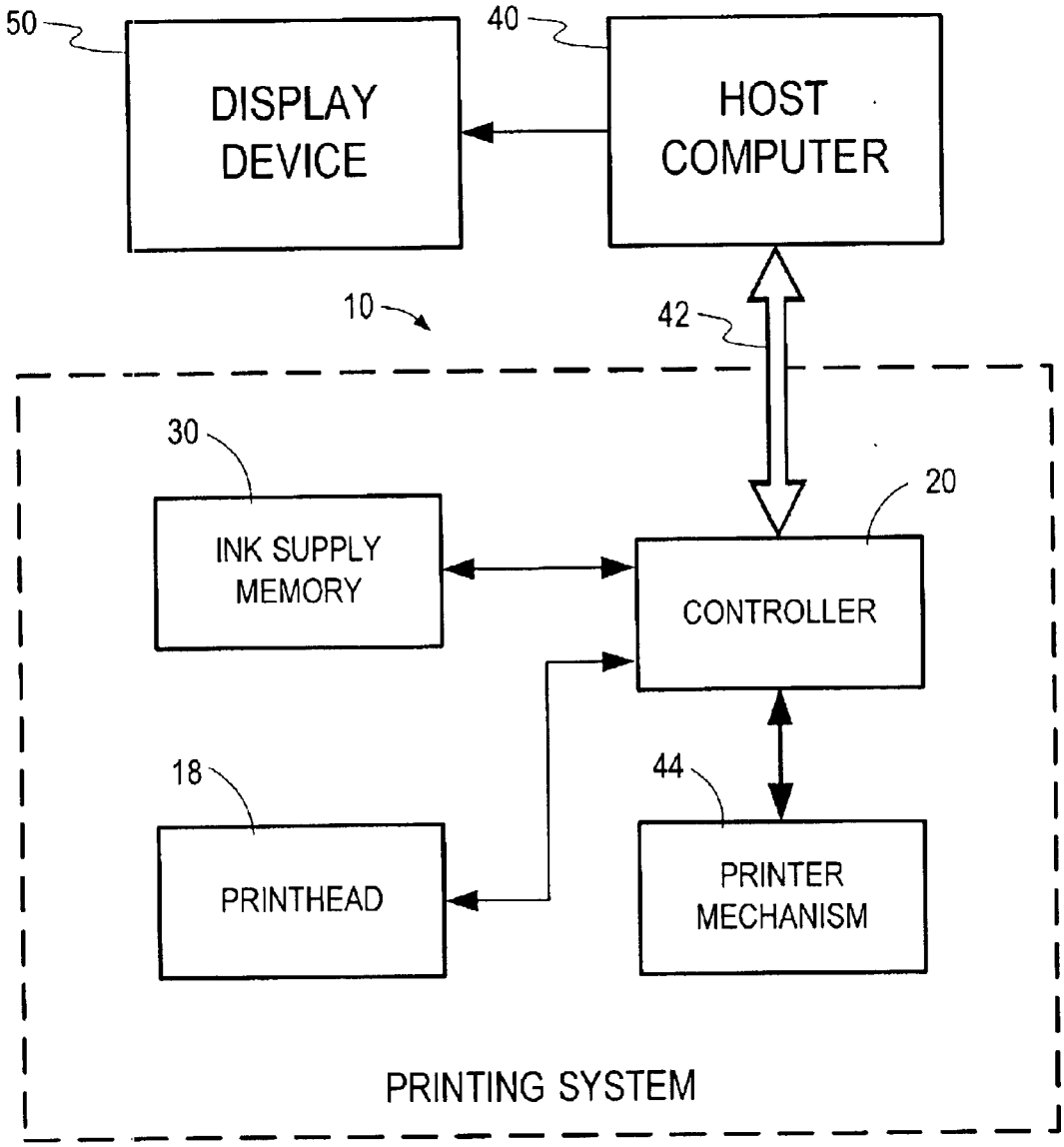
FIG. 2 is a block diagram further depicting the exemplary inkjet printing system of FIGS. 1A and 1B.

FIG. 2 is a generalized block diagram representing an exemplary inkjet printing system 10 shown connected to an information source or host computer 40. The host computer 40 may be a conventional computer including a display device 50, such as a workstation, server or personal computer, to name a few, that provides image information to the controller 20 by way of a link 42. The link 42 is a typically a conventional printer interface such as an electrical link or an infrared link for allowing information transfer between the host computer 40 and the printing system 10.

The controller 20 controls a printer mechanism 44 and the printhead 18 to selectively eject ink droplets as the printhead and print media are moved relative to each other. Various parameters for controlling operation of the printing system 10 are provided by the host computer 40 or are provided by the memory 30 associated with the ink supply 12. Printer parameter information provided by the host computer 40 is typically resident in printer control software that is typically referred to as the "printer driver".

Among the parameters stored in the memory 30 on ink container 12 may be the following: actual count of ink drops emitted from the printhead 18; date code of the ink supply; date code of initial insertion of the ink container 12; system coefficients; ink type/color; ink container size; print mode; temperature data and heater resistor parameters; age of the ink container; drop count for the printhead 18; a pumping algorithm for the case where the ink container 12 is pressurized for higher ink flow rates between the ink container 12 and printer portion 14; printer serial number; cartridge usage information; to name a few.

Upon insertion of the ink container 12 into the printer portion 14 the controller 20 reads the parameter information from the memory 30 for controlling various printing functions within the printing system 10. For example, the controller 20 may compute an estimate of remaining ink in the ink container 12 and compare the estimate against prerecorded supply thresholds, and inhibit printing if the estimate of remaining ink is below a threshold to prevent dry firing of the printhead which can result in a damage to the printhead 18.

Another example of how parameter information stored in the memory 30 can be used by the controller 20 is to verify that proper ink type and color is installed properly in the printing system 10. In addition, the controller 20 can provide a notice to the user when the ink within the ink container 12 is beyond its shelf-life so that the ink container 12 can be replaced ensuring maximum print quality.

The ink in an ink supply has a useable life based on the ink chemistry and other factors, such as the water vapor transmission rate (WTVR) through components of the supply. Inks formulated for different applications, or inks stored in different containers, may have different useable lives. For example, ink for applications requiring a high degree of color fidelity may have a shorter useable life than inks for general business or personal use. An ink supply may also have an expiration date or an "install before" date, based on the limited shelf-life of the supply.

Figure 3A:
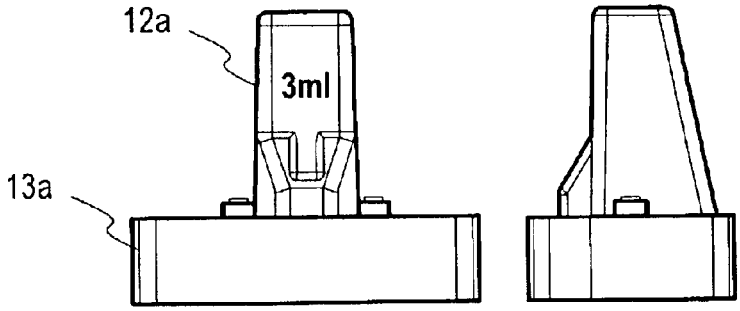
Figure 3B:
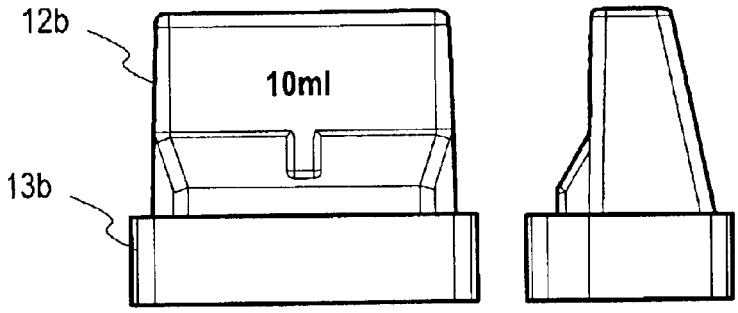
Figure 3C:
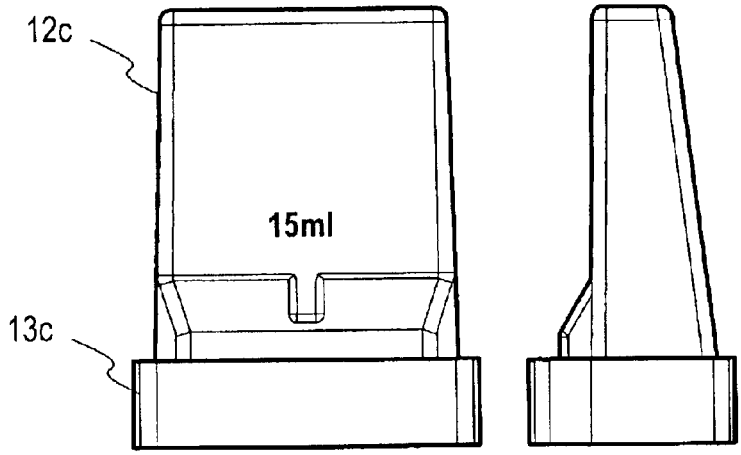

To accommodate the differing usage rates by consumers, replacement ink supplies may be provided in a variety of sizes or ink capacities. FIGS. 3A, 3B, and 3C illustrate embodiments of multiple sizes of ink containers 12*a*, 12*b*, 12*c* all having interconnect portions 13*a*, 13*b*, 13*c* adapted to connect with a common ink container receiving station. Each of the containers 12*a*, 12*b*, 12*c* are shown in front view and side view. In the exemplary embodiments illustrated, the ink container of FIG. 3A includes a 3 ml supply of ink; the ink container of FIG. 3B includes a 10 ml supply of ink; and the ink container of FIG. 3C includes a 15 ml supply of ink. Containers with different ink volumes than those illustrated may of course also be provided. The multiple size containers having a common interconnect portion allow the consumer to tailor their container purchases to their individual ink usage pattern. For example, a consumer who does relatively little color printing may purchase 3 ml color ink supplies; a consumer who does extensive color printing may purchase 15 ml color ink supplies.

Figure 4:
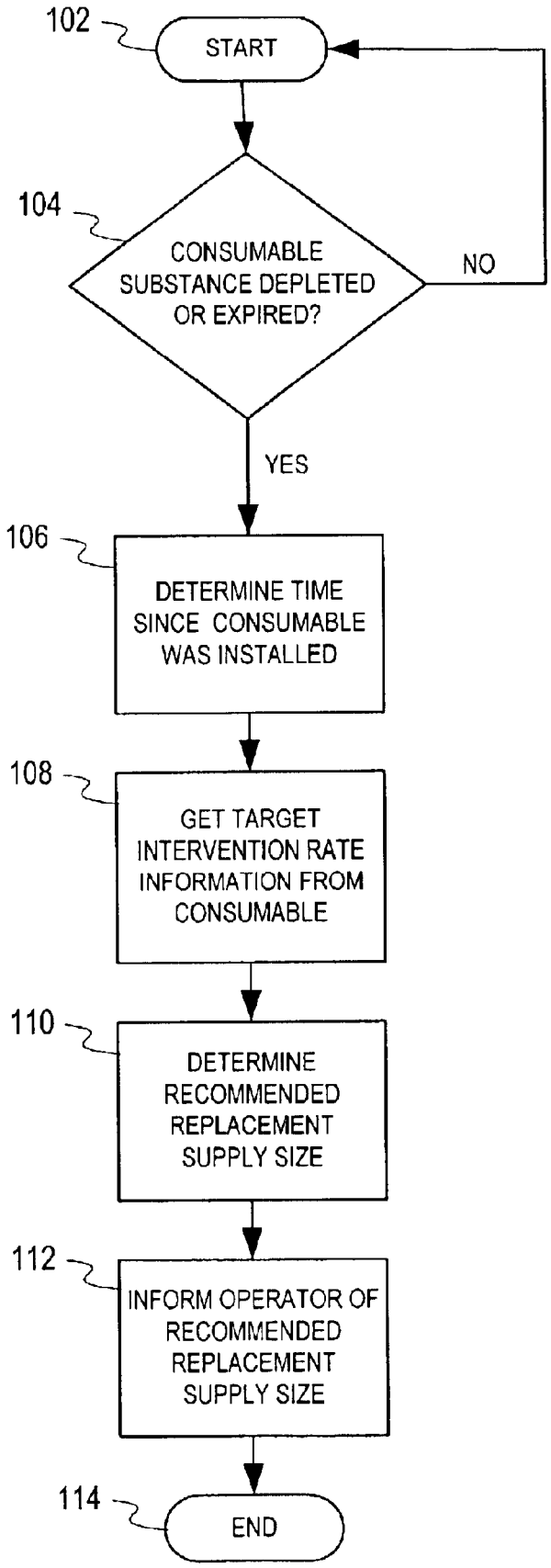
FIG. 4 is a logic flow diagram providing an overview of an embodiment of the present invention.

FIG. 4 is an overview of an exemplary embodiment of the method of the present invention. The present invention contemplates providing apparatus and methods for recommending to a consumer an optimal replacement consumable size, based on a record of the consumer's past utilization rate and on recommended intervention rate information stored in a memory device on the consumable. The method generally depicted in FIG. 4 may be performed by printer control software resident in a host computer; the actual software or firmware implementing the invention may be differently structured than depicted in FIG. 4 while performing essentially the same functions.

As shown in FIG. 4, the exemplary process begins 102 when the currently installed supply becomes depleted or expired 104. A depleted supply may be determined by an "out of ink" (OOI) sensor, as is known in the art. An expired supply may be detected by the printer control software comparing an expiration date stored on the supply memory device with the current date from the computer's real time clock.

If the supply is depleted or expired, the printer control software then determines the time since the supply was initially installed in the printer 106. In an exemplary embodiment, the memory device on the supply may include a data field indicating the "First Insertion Date" of the consumable, which is written by the printer control software when the supply is initially installed in the printer. The printer control software may then determine the time since initial installation by subtracting the value in the "First Insertion Date" data field from the present value of the host computer's real time clock.

Once the printer control software has determined the time since the consumable was installed, it then gets the target intervention rate information from the memory device on the consumable 108. In a preferred embodiment of the invention, the target intervention rate may be coded as a binary value representing the recommended number of interventions per year (IPY), as indicated in Table 1. In the exemplary embodiment shown in Table 1, a two bit binary value is used to indicated recommended intervention rates of from twice per year (binary value "00") to six times per year (binary value "11"). The information may also be stored other formats, or equivalent information, such as a recommended replacement interval, may be stored.

TABLE 1

| Binary ROM Value | Interventions Per Year (IPY) | Printer Behavior |
|---|---|---|
| 00 | 2 | Based on expired cartridge use time, |
| 01 | 3 | recommend a replacement cartridge that |
| 10 | 4 | will produce the interventions per year |
| 11 | 6 | stored in this memory field. |

Based on the duration of time it took the consumer to deplete the currently installed supply and on the "recommended intervention rate" retrieved from the memory device on the currently installed supply, the printer control software determines a recommended replacement supply size 110. In an exemplary embodiment of the invention, a recommended replacement size is determined by calculating from the "interventions per year" a "recommended use time" in months; comparing the "recommended use time" to time since the supply was initially installed; and looking up a recommended replacement in a table, as discussed further with respect to FIG. 5, below.

In the exemplary embodiment, the printer control software then informs the consumer or operator of the printer of the recommended replacement supply size 112, and the process ends 114. The notification may be in the form of a message displayed on the display device of the host computer, or in other forms known in the art.

Figure 5:
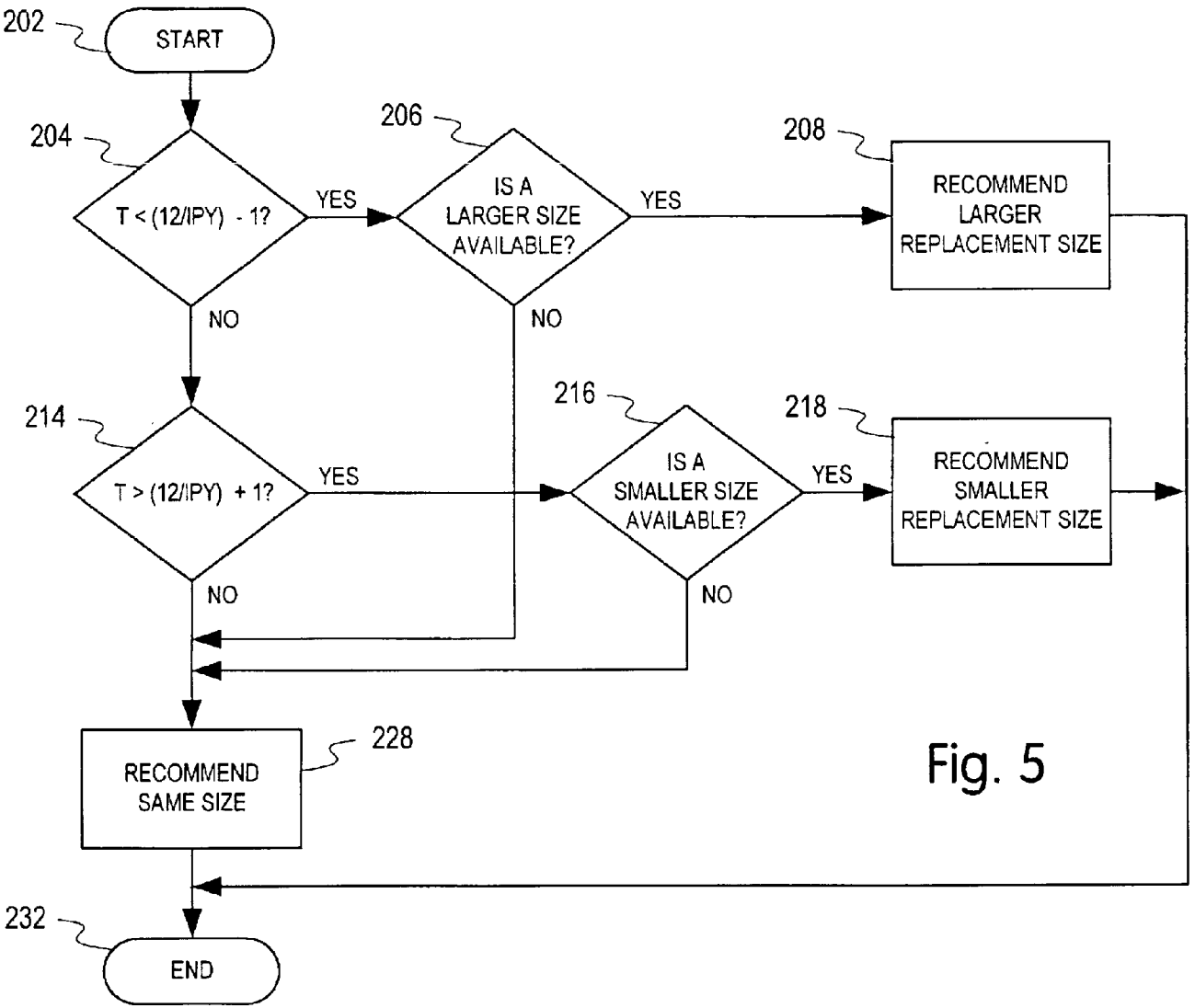
FIG. 5 is a logic flow diagram further illustrating how a recommended replacement size may be determined in an exemplary embodiment of the invention.

A more detailed example of how the printer control software may determine a recommended replacement supply size is provided in Table 2 and FIG. 5.

TABLE 2

| Expired Cartridge Size | Expired Use Time, Months* | Recommended Replacement Cartridge Size |
|---|---|---|
| 3 ml | <(12/IPY) − 1 | 10 ml |
| | >(12/IPY) + 1 | 3 ml |
| | else | 3 ml |
| 10 ml | <(12/IPY) − 1 | 15 ml |
| | >(12/IPY) + 1 | 3 ml |
| | else | 10 ml |
| 15 m1 | <(12/IPY) − 1 | 10 ml |
| | >(12/IPY) + 1 | 15 ml |
| | else | 15 ml |

*IPY = recommended interventions per year

The following example illustrates the exemplary embodiment of Table 2. Assume that the consumer currently has a 10 ml ink supply installed, and that the recommended "interventions per year" for the supply is four (encoded in Table 1 as "10"), meaning that optimal printing results are obtained when the ink in the supply is completely utilized within approximately three months. If the consumer uses up the ink in the supply in less than two months [(12/4)−1=2], then the printer driver software, upon detecting that the supply is empty, recommends to the consumer that the empty 10 ml container be replaced with a larger 15 ml container. If instead the consumer uses up the ink in more than four months [(12/4)+1=4], then the printer driver software, upon detecting that the container is empty, recommends to the consumer that the empty 10 ml container be replaced with a smaller 3 ml container. Finally, if the consumer uses up the ink in the container within the optimal period of two to four months ["else"], the printer driver software recommends replacing the empty container with a new container of the same size.

If the consumer is already utilizing the largest or smallest available supply size, the above-described exemplary procedure is accordingly modified as indicated in the "3 ml" and "15 ml" rows of Table 2. While recommending a smaller replacement supply serves to insure that the ink is utilized within an optimal time period, recommending purchase of a larger supply is for the convenience of the consumer, in that the frequency of replacement is reduced.

FIG. 5 further illustrates in flowchart form how a recommended replacement size may be determined in the exemplary embodiment of the invention. At the beginning 202 of the process, the printer control software determines 204 if the supply was depleted too quickly. The total time it took the consumer to deplete the supply, "T" is compared to a value, (12/IPY)−1, derived from the recommended intervention rate, as discussed with respect to Table 2, above. If "yes", and if a larger size supply is available 206, the consumer is advised 208 to replace the depleted supply with a larger size. If a larger size is not available, the consumer is advised 228 to replace the depleted supply with the same size supply, and the procedure ends 232.

If the time it took the consumer to deplete the supply is not less then the value derived from the recommended intervention rate, the procedure then determines 214 if the supply was depleted too slowly. "T" is compared to the another value, (12/IPY)+1, as discussed with respect to Table 2, above. If "yes", and if a smaller size supply is available 216, the consumer is advised 218 to replace the depleted supply with a smaller size. If a smaller size is not available, the consumer is advised 228 to replace the depleted supply with the same size supply, and the procedure ends 232.

While FIG. 5 depicts an exemplary embodiment with three replacement sizes, the methods of the present invention may be adapted to a greater number of replacement sizes, or to only two replacement sizes. "Replacement size" may also refer to containers having the same external appearance, but varying internal ink volumes. The actual software or firmware implementing the invention may also be differently structured than depicted in FIG. 5 while performing essentially the same functions.

The present invention may also be used in applications other than inkjet printing in which a container for a consumable substance has an integral memory device for storing calibration and control information.

While the present invention has been particularly shown and described with reference to the foregoing preferred and alternative embodiments, those skilled in the art will understand that many variations may be made therein without departing from the spirit and scope of the invention as defined in the following claims. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. A printing system adapted to receive replacement consumables having differing consumable capacities, the printing system having electrical interconnects to retrieve from an electronic storage device on a consumable information indicative of a target intervention rate for the consumable and information indicative of a first install date for a consumable, the printing system further comprising executable code for recommending to a printing system user an optimal replacement consumable capacity based on the retrieved information.

2. The printing system adapted to receive replacement consumables having differing consumable capacities of claim 1, wherein the executable code for recommending to a printing system user an optimal replacement consumable capacity comprises printer control software executable on a host computer.

3. A method of advising a printer user of an optimal-size replacement printing consumable to replace a currently installed consumable, the method comprising:

detecting if a new printing consumable is required;

determining the time since the currently installed consumable was initially installed in the printer;

retrieving from a memory device integral to the currently installed consumable information indicating a target intervention rate for the currently installed consumable;

determining from the time since the currently installed consumable was initially installed in the printer and the target intervention rate a recommended replacement consumable size; and conveying to the consumer information identifying the recommended consumable size.

4. The method of advising a printer user of an optimal-size replacement printing consumable of claim 3, wherein detecting if a new container of consumable substance is required comprises detecting that the currently-installed printing consumable is depleted.

5. The method of advising a printer user of an optimal-size replacement printing consumable of claim 3, wherein detecting if a new container of consumable substance is required comprises determining that the currently-installed printing consumable is older than the currently-installed consumable's expiration date.

6. The method of advising a printer user of an optimal-size replacement printing consumable of claim 5, wherein the currently-installed consumable's expiration date is retrieved from information encoded in the memory device integral to the currently installed consumable.

7. The method of advising a printer user of an optimal-size replacement printing consumable of claim 3, wherein determining the time since the currently installed consumable was initially installed in the printer comprises subtracting a numerical value indicative of a date on which the currently-installed consumable was first installed in a printer from a numerical value indicative of the current date.

8. The method of advising a printer user of an optimal-size replacement printing consumable of claim 7, wherein the numerical value indicative of a date on which the currently-installed consumable was first installed in a printer is retrieved from information encoded in the memory device integral to the currently installed consumable.

9. The method of advising a printer user of an optimal-size replacement printing consumable of claim 7, wherein the numerical value indicative of the current date is determined from a real-time clock of a host computer.

10. The method of advising a printer user of an optimal-size replacement printing consumable of claim 3, wherein the memory device integral to the currently installed consumable comprises a non-volatile semiconductor memory.

11. The method of advising a printer user of an optimal-size replacement printing consumable of claim 3, wherein determining a recommended replacement consumable size comprises:

computing from the information indicating a target intervention rate for the currently installed consumable an optimal time range for utilization of the consumable, the optimal time range for utilization having a low end and a high end;

comparing the time since the currently installed consumable was initially installed in the printer to the optimal time range low end and to the optimal time range high end; and based on the comparisons, accessing a table of available replacement consumables.

12. The method of advising a printer user of an optimal-size replacement printing consumable of claim 3, wherein conveying to the consumer information identifying the recommended consumable size comprises displaying a message on a display device of a host computer.

13. The method of advising a printer user of an optimal-size replacement printing consumable of claim 3, wherein the printing consumable comprises an ink supply.

14. The method of advising a printer user of an optimal-size replacement printing consumable of claim 13, wherein the printing consumable further comprises a printhead.

* * * * *